United States Patent [19]

Draper et al.

[11] Patent Number: 4,558,803

[45] Date of Patent: Dec. 17, 1985

[54] MECHANISM FOR CONVERTING STACK ACCESS NEWSPAPER VENDING MACHINES AND THE LIKE TO MACHINES FOR DISPENSING PRODUCTS ONE AT A TIME

[75] Inventors: Reed T. Draper, 8305 Summerfeldt St., Saginaw, Mich. 48603; Kenneth J. Pol, Saginaw, Mich.

[73] Assignee: Reed T. Draper, Saginaw, Mich.

[21] Appl. No.: 613,641

[22] Filed: May 24, 1984

[51] Int. Cl.[4] ..... B65H 3/06

[52] U.S. Cl. ..... 221/229; 221/249

[58] Field of Search ..... 221/249, 259, 231, 213–216, 221/227, 228, 229; 271/18.3, 21, 22, 84, 95

[56] References Cited

U.S. PATENT DOCUMENTS

| | | | |
|---|---|---|---|
| 1,926,848 | 9/1933 | Giles | 221/227 |
| 3,831,809 | 8/1974 | Knickerbocker | 221/227 |
| 4,319,695 | 3/1982 | Dutro | 221/213 |
| 4,469,246 | 9/1984 | Albright et al. | 221/231 X |

*Primary Examiner*—Stanley H. Tollberg

*Attorney, Agent, or Firm*—Learman & McCulloch

[57] ABSTRACT

A coin operated vending machine delivers single newspapers and/or similar articles from the upper end of a stack of articles out a vending slot. A roller engages the article and moves it part of the way out the slot so that it can be grasped by the customer and pulled the remaining distance. An actuator, such as the access door used on vending machines currently in the field, is linked with the roller to revolve it in a dispensing direction, but the motion transmission mechanism for the roller does not transmit rotation in the opposite direction and permits the roller to revolve independently of the motion transmission mechanism.

17 Claims, 7 Drawing Figures

MECHANISM FOR CONVERTING STACK ACCESS NEWSPAPER VENDING MACHINES AND THE LIKE TO MACHINES FOR DISPENSING PRODUCTS ONE AT A TIME

BACKGROUND OF THE INVENTION

This invention is directed to the conversion of coin operated vending machines in which the unlatching of a front door, via deposit of the proper coins in a coin latch mechanism, provides access to an entire stack of newspapers. The newspaper vending machine believed to be in widest use today is believed to be the one disclosed in U.S. Pat. No. 3,174,608, in which the newspapers are supported in a generally vertical stack and the coin controlled access door is opened to permit the party who inserted the coins to remove a newspaper from the top of the stack. These are called "full access" machines, in the sense that, once access is obtained, the customer has the option of removing one newspaper or the entire stack.

Because of the considerable variety of money-saving coupons which are provided in newspaper advertisements these days, which people need only to clip out of the newspaper and use in a retail store to obtain a considerable discount, or to obtain additional items of the type purchased for no cost, there is now a definite incentive for people to accumulate as many newspapers as possible to obtain these coupons for their own use, or for sale to others. As a result, considerable difficulty is being encountered with vending machines of this type which depend upon the honesty and goodwill of the people using them.

There are various "one-at-a-time" dispensing machines on the market today, as exemplified in the following patents:

| | |
|---|---|
| 479,688 | 4,043,484 |
| 2,576,636 | 4,067,477 |
| 2,929,480 | 4,139,120 |
| 3,042,250 | 4,174,047 |
| 3,114,475 | 4,273,255 |
| 3,708,087 | 4,413,749 |
| 3,747,733 | |

No one has yet, to our knowledge, however, perfected a conversion mechanism which permits the continued use of the many thousands of full access vending machines already in place throughout the country.

One of the prime objects of the present invention is to provide mechanism which converts a stack access vending machine to a machine which dispenses only a single article at a time, and does so in a relatively simple manner, which makes it worthwhile to retain the vending machines already in the marketplace, rather than replace them with new machines.

Another object of the invention is to provide a single article dispensing machine which does not require a new coin box, or new latching mechanism, and which makes use of the present access door in already existing vending machines. The present invention uniquely uses the motive power of the access door to operate a newspaper dispensing roller, which is in engagement with the top newspaper in the stack, to dispense that newspaper out to a position in which it is accessible when the door is opened.

Another object of the inventicnis to provide a vending machine which has the capability of dispensing articles of varying thickness, and in an efficient and reliable manner.

Still another object of the invention is to convert such coin-operated vending machines to machinery which may deliver other appropriate products.

Still another object of the invention is to provide improved vending machines which are difficult to loot and vandalize.

A coin-operated vending machine is provided in which the power of the access door is used to deliver the front edge of the newspaper out a vending slot behind the access door, via a roller. Incorporated with the roller, is a mechanism for permitting it to revolve when the customer pulls the newspaper the rest of the way out of the slot, and mechanism for preventing it from rotating when the access door is returned to position.

Other objects and advantages of the invention will be pointed out specifically, or will become apparent from the following description, when it is considered in conjunction with the appended claims and the accompanying drawings.

IN THE DRAWINGS

THE DESCRIPTION

Figure 1:
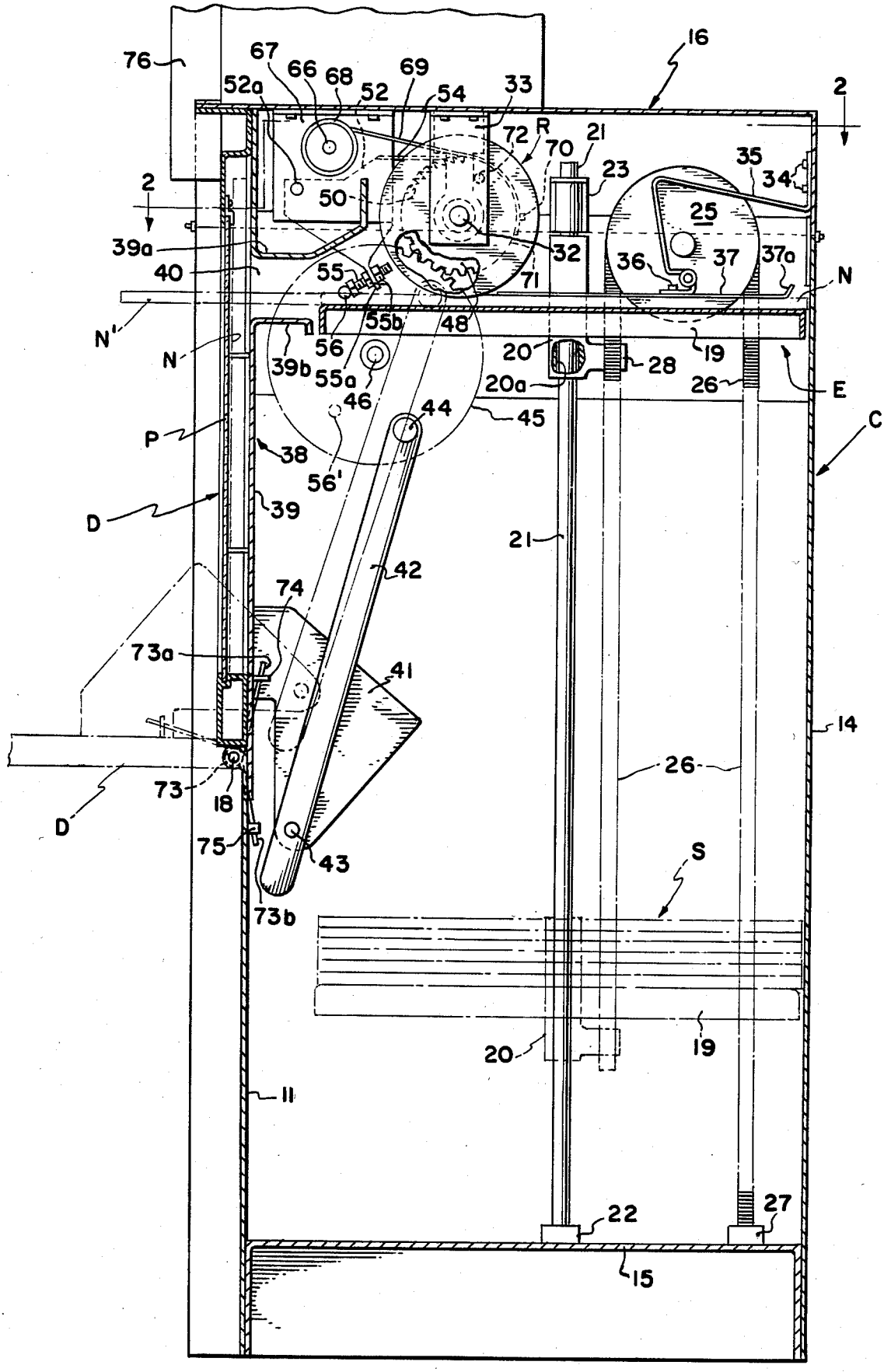
FIG. 1 is a sectional side elevational view through the vending cabinet, taken along the lines 1—1 of FIG. 2, the chain lines indicating a lower position of the stack supporting elevator platform, and, also, a swung-down position of the front door which is employed in much of the equipment already on the market.

Referring now more particularly to the accompanying drawings, wherein a preferred embodiment only of the invention has been illustrated, a letter C generally designates the vertically disposed, oblong cabinet which has side walls consisting of front wall 11, end walls 12 and 13, and a rear wall 14. In addition, a bottom wall 15 is welded in position, and a top cover, generally designated 16, which later will be described in more detail, is hingedly connected to the cabinet C at 17, when the units presently in use are converted to the new construction.

Prior units on the market have included an access door, generally designated D, which is hingedly connected to the front wall 11 at 18 and, in existing prior art constructions, was utilized to load a stack of newspapers to a compartment in the cabinet C. Door D, as indicated particularly in FIG. 3, included an outer transparent panel 19, and a compartment behind the panel 19 was provided to accommodate a newspaper N in order to display the headline portion of the front page of the newspaper and attract the attention of passers-by. To convert existing vending cabinets, it is expedient, first of all, to provide an elevator mechanism, generally designated E in FIG. 1. The mechanism E includes a stack supporting platform 19, to the ends of which laterally projecting brackets 20 are affixed. The brackets 20 have openings 20*a* providing bearing surfaces for vertical travel along guide rods 21, which have threaded ends secured in sockets 22 fixed on the floor 15. The rods 21 may be secured at their upper ends by braces 23, with openings 23*a* which pass the upper ends of the rods 21.

Figure 6:
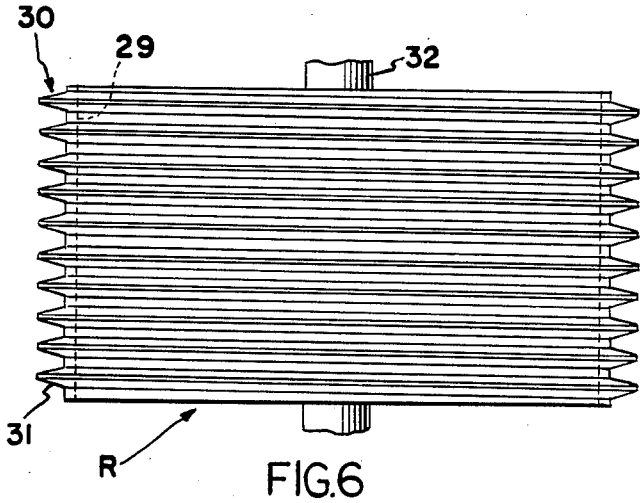
FIG. 6 is an enlarged top plan view of the dispensing roller.

Provided at each end of the cabinet C, on a support shaft 24, is a rotatable pulley 25, around which an elongate coil spring 26 is trained. The shafts 24 are mounted at diagonally opposite ends of the platform 19. One end of each coil spring 26 is secured to a fitting 27 on floor 15. The opposite end is secured to the elevator platform bracket 20 at 28. With the arrangement indicated, the coil springs 26 will urge the elevator platform 19 in an upward direction with a relatively constant force (regardless of the vertical position of platform 19), against a dispensing roller, generally designated R, which is more particularly illustrated in FIG. 6. As FIG. 6 indicates, the roller R comprises a rigid core 29, over which a resilient, soft rubber sleeve 30 is fixed, sleeve 30 having a series of depressible, integrated radially projecting ribs or gripper rings 31, as shown. The roller core 29 is fixed to a shaft 32 and is driven in a manner which will presently be described, shaft 32 being supported by the hinged cover 16, in bearing brackets 33 which depend therefrom.

Also secured to the cover 16, as with bolts 34, is a spring 35 which is affixed, by means of bolts 36 or the like, to a shoe 37 positioned rearwardly of roller R. It will be observed that the front end of the shoe 37 extends in under roller R (see FIG. 1), and at its rear end is upturned as at 37*a*. When roller R is being rotated in a clockwise direction in FIG. 1 to dispense the newspaper N which is shown supported on platform 19, shoe 37 operates to hold the rear end of the folded newspaper down on platform 19. Springs 26 and 35 plainly act in opposition to control the vertical position of the uppermost newspaper in the stack S being supported.

In the conversion construction, a solid replacement front panel 38 is provided to extend between the end walls 12 and 13 to block access to the interior of cabinet C when door D is swung to the open position. The partition 39 is provided with a dispensing slot 40 bounded by rearwardly extending flanges 39*a* and 39*b*.

Figure 2:
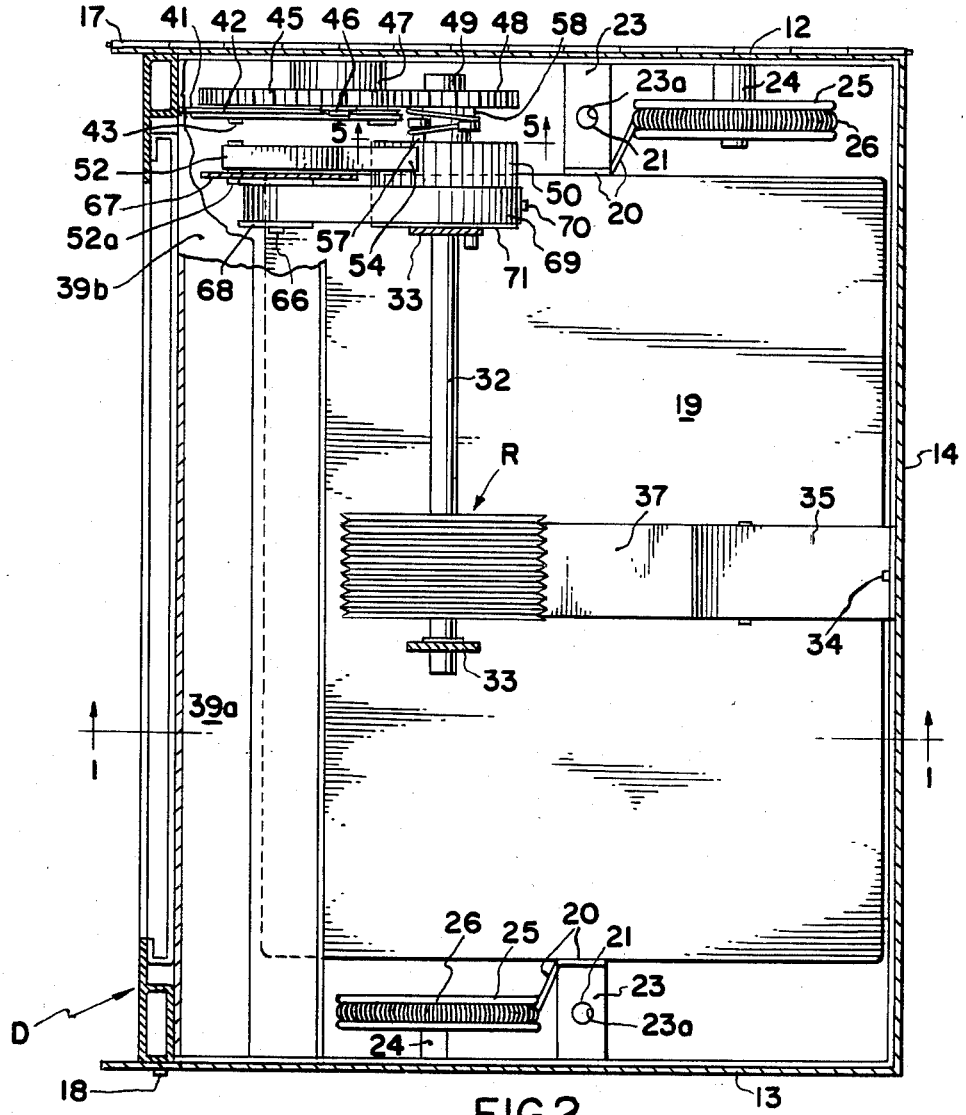
FIG. 2 is a sectional top plan view taken on the line 2—2 of FIG. 1.

The dispensing operation, involving movement of a newspaper edge partly out of opening 40 to the point where it can be grasped by a customer and pulled the remainder of the way out, is initiated and accomplished through movement of the door D from the vertical position through a 90 degree angle to the horizontal position shown in FIG. 1. A bracket 41 fixed to the lower end of door D to extend interiorly into the cabinet pivotally mounts a crank arm 42, as at 43, which pivotally connects at 44 to gear 45. As FIG. 2 particularly indicates, the gear 45 is mounted for free rotation on a stub shaft 46, received in a bearing 47 supported by the one end wall 12. Provided on shaft 32, in mesh with spur gear 45 is a spur gear 48, mounted for free rotation on the shaft 32 for a purpose to be presently explained, and retained thereon by a lock fitting 49.

Also provided as part of the drive transmission mechanism, is a ratchet wheel 50 mounted on shaft 32 by an overrun clutch mechanism 51. Mounted on a bracket 52, which is pivoted to cover 16 at 52*a*, is a pawl member 54 which is lifted out of engagement with the teeth of the ratchet wheel 50 when bracket 52 is moved in a counterclockwise direction in FIG. 1 about pivot 52*a*. It will be observed that the lower end of bracket 52 includes a lip 55*a*, which has an opening through which a bolt 55 is threaded. Lock nuts 56 then are provided on either side of the lip 55*a* for locking the bolt 55 in adjusted position. Normally a pin 56, which projects from the face of gear 45, is in engagement with the head of bolt 55 and has swung bracket 52 sufficiently in a counterclockwise direction to lift the pawl 54 out of tooth engaging position. When door D is opened and link 42 is raised to rotate gear 45 in a counterclockwise direction in FIG. 1, the pin 56 moves to the broken line position 56'. As soon as the pin 56 clears the bolt 55, the pawl 54 reengages ratchet wheel 50.

Figure 5:
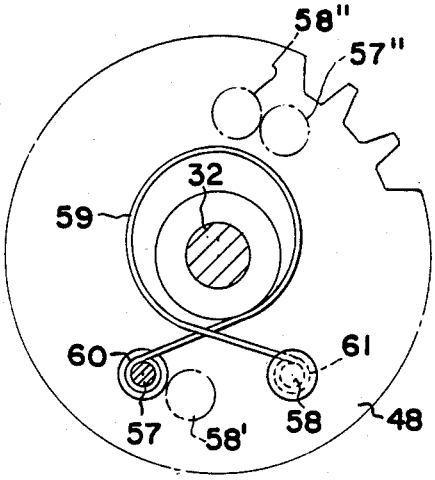
FIG. 5 is an enlarged, fragmentary, vertical elevational view taken on the line 5—5 of FIG. 2.

Provided on ratchet wheel 50 is an axially extending pin 57 (FIGS. 2 and 5) which extends into the rotary path of a like axially projecting pin 58 provided in a like radial position on the face of gear 48. When pin 58 on gear 48 has moved to the broken line position 58' in its clockwise path of rotation (in FIG. 5), it will engage the pin 57 and cause the ratchet 50 to also rotate in a clockwise direction. The chain line locations of the pins 57 and 58, at the end of the travel of link 42 upon opening of door D, are shown at 57'' and 58'', respectively in FIG. 5. Provided to return the pins 57 and 58 to the solid line positions shown in FIG. 5, is a radially expansible spring member 59 having one end 60 encircling and secured to pin 57, and another end 61 encircling and secured to pin 58.

Figure 7:
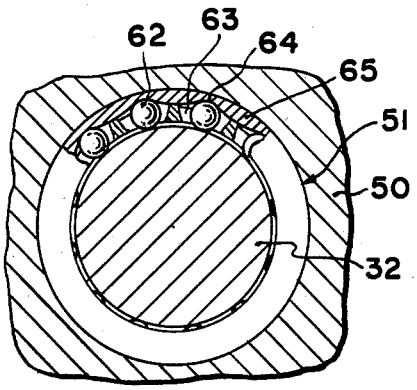
FIG. 7 is an enlarged, fragmentary, sectional elevational view of the ratchet wheel which discloses the clutch incorporated therewith.

The drive of ratchet wheel 50, in a clockwise direction in FIG. 7, will be transmitted by clutch 51 to drive shaft 32 and roller R. The clutch 51 may be one of those manufactured by the Torrington Company of Torrington, Conn., and referred to as its drawn cup roller clutch. In a clutch of this type, rollers 62, positioned by the retainer spring 63, advance into locked position against ramps 64, provided on an outer ring 65, and transmit the clockwise rotation of ratchet wheel 50 to the shaft 32, via balls 62. An over-running operation, which is not transmitted to ratchet 50, is permitted by the clutch 51, when roller R is thereafter rotated by the customer pulling a newspaper the full way out of the cabinet.

Provided on a shaft 66, supported by a bracket 67 from cover assembly 16, is a pulley 68 on which a constant tension return spring 69 is wound, the free end of spring 69 being secured, as with a rivet member 70, to a drum portion 71 which comprises an axial extension of ratchet wheel 50. Provided on ratchet wheel extension drum portion 71 in which clutch 51 is press fitted, is an axially extending pin 72 which limits travel of the drum 71 via its engagement with a cover mounted bracket 33, as disclosed in FIGS. 1 and 2, when spring 69 is moving drum 70 and ratchet wheel 50 in the return direction.

Provided to return door D, are the usual torsion springs 73, having coils encircling each hinge pin 18, and ends 73*a* and 73*b* which are trapped in fittings 74 and 75, provided on the door D and front wall 11 of the cabinet, respectively.

Mounted on top of cover 16 is the usual coin latch mechanism housing 76, which includes a coin insertion slot 77. Such coin controlled latching mechanisms are disclosed in U.S. Pat. Nos. 4,037,701; 2,984,326; 3,174,608; 3,125,247; 3,265,177; 3,403,765; 3,464,530;

3,738,466; 3,882,984; 3,946,848; and 4,000,799 and are provided in vending machines which have been in service for years. Typically, access door D will have an access door extension 78, with a handle 79 provided thereon (see FIG. 3). The extension 79 has an inwardly extending latch plate received within the coin mechanism housing 76, which remains latched until the proper coins are inserted in the slot 77. A typical such construction is shown in U.S. Pat. No. 4,000,799, for instance. Coin controlled latch mechanisms 76 of conventional construction include a coin return chute 80 and a coin return button 81. For present purposes, it is sufficient to disclose that, when proper coins are inserted into the coin box 76, the member 78 is unlatched and the door D can be swung to the open position.

Figure 3:
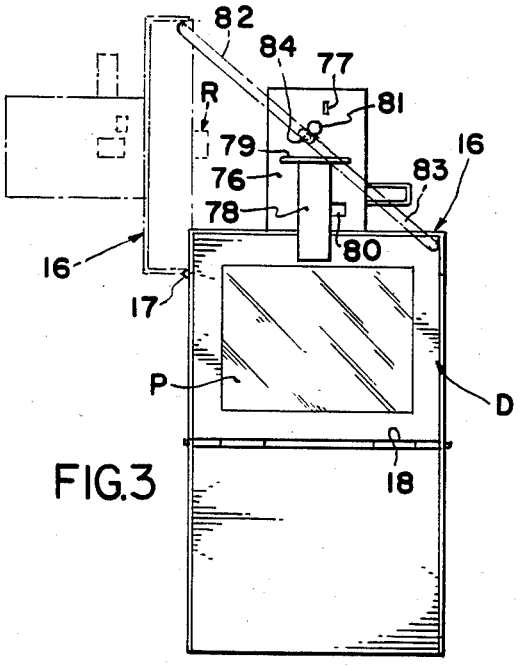
FIG. 3 is a reduced size, front elevational view of a converted vending machine, the chain lines indicating a swung-open position of the top access cover or door to permit the loading of newspapers to the elevator platform.
Figure 4:
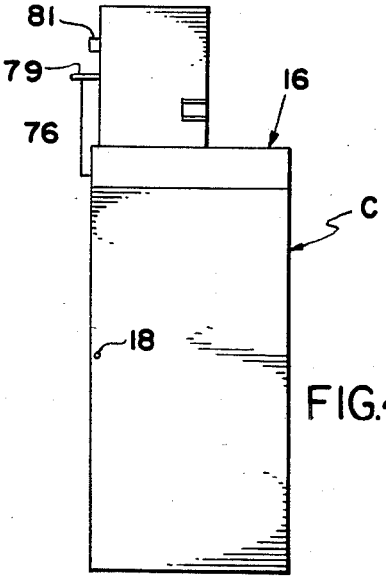
FIG. 4 is a side elevational view thereof.

When the member 78 is unlatched, the cover unit 16 may also be swung to the open position about the hinge pins 17 disclosed in FIG. 3, the brace members 82 and 83 connected by a hinge pin 84 being operative to support the cover C in this position. Cover 16 carries the operating elements including gear 48 (which is lifted out of mesh with gear 45), shaft 32, ratchet wheel 50, pawl 54, roller R, and shoe 37 with it, such that none of these will interfere with loading of a stack of newspapers to the platform 19.

THE OPERATION

When it is desired to dispense a newspaper N, a customer deposits the required coins in slot 77, which triggers mechanism releasing the door strap 78 and permits him to pull handle 79 outwardly to swing door D down to the open position shown in broken lines in FIG. 1. The effect of this is to raise link 42 and revolve gear 45 in a counterclockwise direction, which moves pin 56 away from the bolt 55 and permits the pawl 69 to swing down about bracket pivot **52*a* under the influence of gravity and reengage between the teeth of ratchet wheel 50. At the same time, gear 48 is driven in a clockwise direction in FIG. 1 and FIG. 5 (with play between gears 45 and 48 permitted) until the pin 58 engages ratchet wheel pin 57 and drives the ratchet wheel 50 in a clockwise direction as shown in FIG. 7. This, via clutch 51, then rotates shaft 32 and roller R clockwisely in FIGS. 1 and 7 to move the topmost newspaper out of slot 40 to approximately the position shown in FIG. 1. Though only a single newspaper is shown on top of the platform 19 in FIG. 1, it is to be understood that normally platform 19 will be supporting a stack S of newspapers and it is the topmost newspaper which is dispensed. Once the topmost newspaper N has been moved to the position indicated by the chain lines N′ in FIG. 1, the customer grasps the edge of the newspaper and pulls it the remaining way out slot 40. While this has the effect of rotating roller R in a clockwise direction in FIG. 1, the further rotation has no effect on the ratchet wheel 50 because its drive is not transmitted by clutch 51**.

When permitted by the customer, the door D will be closed by the springs 73. When the door D is in the process of closing, rotation of wheel 45 in a clockwise direction is transmitted to gear 48 which simply returns pin 58 from the 58″ position to the solid line position shown in FIG. 5. When the door D nears closed position, the pin 56 will engage the adjusting bolt 55 and swing bracket 52 counterclockwisely such that pawl finger 54 is removed from the ratchet wheel 50. This permits spring 69 to restore the drum 71, ratchet wheel 50, and pin 57 to original "ready" position, pin 57 moving from the 57″ position to the solid line position shown in FIG. 5. The pin 72 will eventually engage bracket 33 and halt pin 57 in the desired position. As will be apparent, a very practical, reliable construction has been provided for converting machines in present day use to machines in which only a single newspaper at a time is dispensed. This is accomplished by mere opening of the door D which formerly provided access to an entire stack of newspapers.

While one embodiment of the invention has been described in detail, it will be apparent to those skilled in the art that disclosed embodiments may be modified. Therefore, the foregoing description in all aspects is to be considered exemplary rather than limiting in any way, and the true scope of the invention is that defined in the following claims.

What is claimed is:

1. Conversion improvements in vending machines for newspapers and like articles, which have access doors in their side walls for enabling the articles to be loaded in a stack to a cabinet and comprising:

a. a cabinet enclosure with side walls and a top wall;

b. a door hinged to one side wall and forming a part thereof;

c. coin controlled latch mechanism for normally locking the door to the cabinet in closed position except when proper coins are fed to the mechanism;

d. a generally horizontally disposed platform and elevator mechanism supported by said cabinet for incremental vertical movement therein and adapted to support a stack of said articles;

e. wall means behind said door, blocking access to said stack except for a dispensing opening for the dispensing of one article at a time near the upper end of the enclosure behind the upper portion of the door, which is accessible when the door is open;

f. means for moving said platform and elevator mechanism upwardly to dispose the topmost article opposite said dispensing opening;

g. a dispensing member mounted by the cabinet in engagement with the topmost article and movable in a path of travel to dispense the topmost article in the stack at least partly out said dispensing opening;

h. and linkage and drive mechanism connecting said door with said dispensing member such that opening of said door activates the dispensing member to dispense the topmost article, said linkage and drive mechanism including means for disabling the mechanism connecting said door and dispensing member during the terminal portion of the return travel of the door.

2. The improvements of claim 1 wherein said dispensing member comprises a roller, and said roller is mounted on a horizontal shaft supported by the cabinet adjacent the dispensing opening and parallel thereto.

3. The improvements of claim 2 in which a drive member is mounted on said shaft for imparting rotation thereto in only one direction; and means connects said drive member with said linkage mechanism.

4. The improvements of claim 3 in which an overrunning clutch is incorporated with said shaft and transmits said rotation thereto.

5. The improvements of claim 4 in which said drive member comprises a gear mounted for free rotation on said shaft, which has a pin projecting parallel to its axis;

a ratchet wheel is provided on said shaft and has a pin projecting parallel to its axis into the path of said gear pin to be rotated thereby after a predetermined travel of said gear pin; a pawl is mounted to be in engagement with the ratchet during opening of the door and to be out of engagement with it when the door is closed; and said clutch is incorporated between said ratchet wheel and the shaft so that drive movement imparted to the ratchet wheel is transmitted to the roller.

6. The improvements of claim 5 in which a constant tension spring is connected with said ratchet wheel, and returns said ratchet wheel pin to original position without driving said shaft in the return direction.

7. The improvements of claim 6 in which said pawl is provided on a mount which pivots about an axis parallel to said shaft, and an abutment is provided on said linkage in position for engaging said mount and raising the pawl to permit return of the ratchet wheel when the door reaches closed position.

8. The improvements of claim 7 in which an adjustable position abutment is provided on said pawl mount to engage with the abutment on said linkage.

9. The improvements of claim 7 in which said linkage includes a rotatable gear in mesh with said gear on the shaft, said abutment is on the face thereof to engage with said adjustable position abutment when the door is closed, and a crank link is connected with said gear to move the abutment on the gear away from the pawl mount adjustable abutment when the door is opened.

10. The improvement of claim 2 in which said roller is disposed near said dispensing opening for engaging the front edge portion of an article to be dispensed and a cabinet supported spring mounted shoe exerts a downward pressure on the rear edge portion of the article to be dispensed during the dispensing operation.

11. The improvements of claim 1 in which the top wall of said cabinet is hingedly connected to the upper end of one of said side walls for movement to a position permitting replacement of a stack of newspapers to the elevator through the top thereof.

12. The improvements of claim 2 wherein said linkage and drive mechanism will move said dispensing roller in only one direction of rotation and will permit rotation of said roller in that direction independently of said linkage and drive mechanism, as when said roller is rotated by a customer pulling the article out of the dispensing opening once a portion thereof is accessible through said opening.

13. The improvements of claim 12 wherein gear and ratchet wheel mechanism is provided for driving said roller which does not drive the roller in a return direction when the door is moving from an open to a closed position.

14. The improvements of claim 13 wherein overrunning clutch means connects said gear and ratchet wheel mechanism with said roller and permits rotation of said roller caused by a customer pulling the article out of the dispensing opening without transmitting such rotation to the gear and ratchet mechanism.

15. Improvements in vending machines for newspapers and like articles comprising:

a. a cabinet enclosure with side walls and a top wall;
b. an actuator mounted to move from a latched position to another position;
c. coin controlled latch mechanism for normally locking the actuator in latched position except when proper coins are fed to the mechanism;
d. a generally horizontally disposed platform and elevator mechanism supported within said cabinet for incremental vertical movement therein, and adapted to support a stack of said articles;
e. wall means incorporated in said cabinet blocking access to said stack except for an article sized dispensing opening for the dispensing of one article at a time near the upper end of the enclosure;
f. means for moving said platform and elevator mechanism upwardly to dispose the topmost article opposite said dispensing opening;
g. a fixed axis dispensing roller member mounted by the cabinet in engagement with the topmost article and rotatable about its axis in a path of travel to dispense the topmost article in the stack at least partly out said dispensing opening;
h. linkage mechanism connecting said actuator with said dispensing member such that movement of said actuator activates the dispensing roller member in one direction of rotation to dispense the topmost article; and
i. motion transmission means interposed between said linkage mechanism and roller member which transmits only movement causing rotation in said direction of rotation and permits rotation of said roller independently of said linkage mechanism in the dispensing direction of rotation, said motion transmission means including a drive for driving said roller member in said dispensing direction of rotation and means incorporated therewith for preventing driving of the roller in the opposite return direction of rotation.

16. The improvements of claim 15 wherein said actuator is an access door, and means is operated by the closing of said door to disable the linkage mechanism connection with said actuator door to permit return of said dispensing roller member in the opposite direction of rotation to original position.

17. The improvement of claim 16 wherein means is provided independently of the closing movement of said door for driving said roller member in the return direction.

* * * * *